US005588645A

United States Patent [19]

Schwan et al.

[11] Patent Number: 5,588,645

[45] Date of Patent: Dec. 31, 1996

[54] BASEBALL PITCHING APPARATUS

[75] Inventors: Fred W. Schwan, Cary; William C. Francis, McHenry, both of Ill.

[73] Assignee: Commercial Concepts, Inc., Cary, Ill.

[21] Appl. No.: 506,089

[22] Filed: Jul. 24, 1995

[51] Int. Cl.[6] ..... A63B 69/40

[52] U.S. Cl. ..... 473/456

[58] Field of Search ..... 273/26 A, 402, 273/410

[56] References Cited

U.S. PATENT DOCUMENTS 2,923,547 2/1960 Heermeman ..... 273/26 A
4,883,272 11/1989 Lay ..... 273/410
4,932,657 6/1990 Hailer ..... 273/410
5,205,564 4/1993 Lamberti ..... 273/26 A
5,271,616 12/1993 Grimaldi ..... 273/26 A

*Primary Examiner*—Theatrice Brown
*Attorney, Agent, or Firm*—Michael J. Femal

[57] ABSTRACT

A baseball pitching apparatus having an unique light weight tubular steel frame separable into components parts and a fabric drape the makes it easy to transport, erect, use and disassemble. The frame and fabric drape combination hold the target area erect while effectively dissipating the energy and redirecting the baseball without any complicate mechanical or electrical mechanisms.

6 Claims, 5 Drawing Sheets

FIG. 6
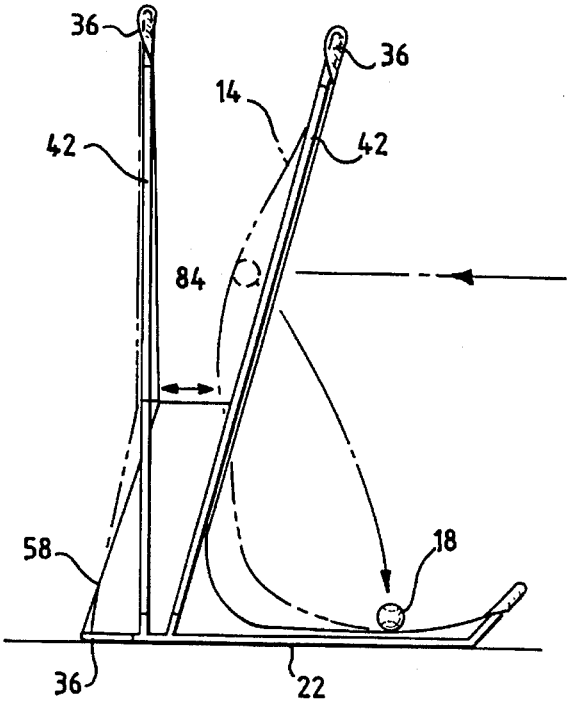
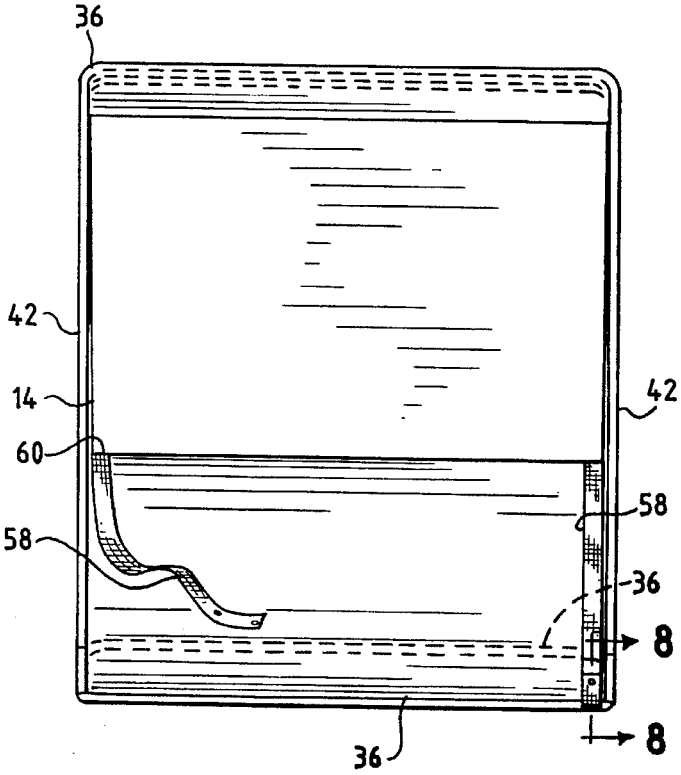
FIG. 7
FIG. 8
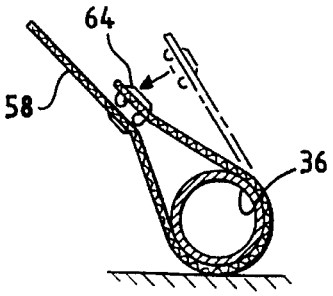

FIG. 9
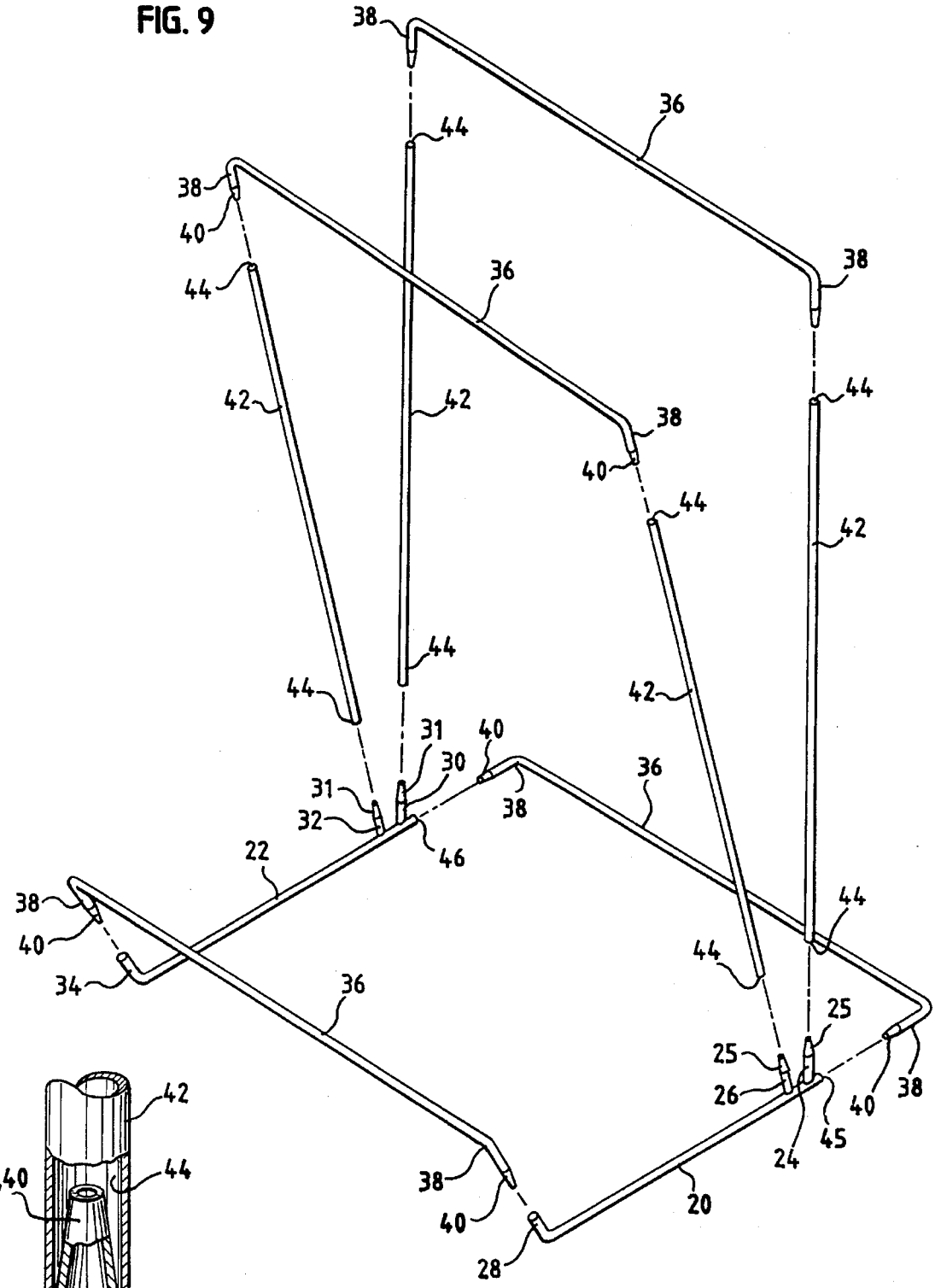
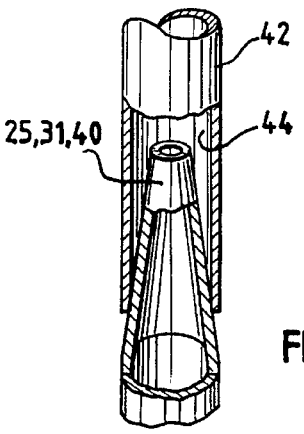
FIG. 10

BASEBALL PITCHING APPARATUS

TECHNICAL FIELD

The invention relates generally to a baseball pitching apparatus, and more particularly with a professional and portable training target to focus and gauge the accuracy of a thrown or struck baseball while dramatically reducing the forward force of the baseball as it is striking the target so it falls harmlessly to a front pocket for later retrieval.

BACKGROUND ART

The baseball pitching apparatus of the present invention provides a good target for a professional level baseball player to focus and gauge the accuracy of his pitches and yet it effectively dissipates the energy and redirects the baseball without any complex mechanism. Prior art reveals several different targets for baseballs and the like but most such devices as U.S. Pat. No. 5,083,774 employs a complex mechanism to help dissipate the energy from a thrown baseball. The frame assembly of the '774 patented device is connected to an underlying base by pivotal bolts and utilizes two extension springs attached diagonally between the frame assembly ends and the base. The other type of angled rearwardly frames with netting as shown in U.S. Pat. Nos. 4,863,166 and 4,932,657 also lack the target area and stability of the present invention which provides a large and ample target for pitching but yet captures the thrown baseball without having the baseball bound away if the center target area is missed.

While the '744 patent attempts to alleviate the impact force of pitched baseballs, the spring mechanism and pivoting bolts are going to provided maintenance problems over a number of pitches and the netting overall presents a less desirable target for throwing baseballs because the netting poorly simulates a solid target like a catchers glove and the reference point of where the balls are hitting the netting is hard to decipher for a pitcher.

These baseball target systems, as shown in the prior art, are incapable of addressing the energy dissipating problem yet provide a good pitching target zone for a professional baseball player like the present invention.

SUMMARY OF THE INVENTION

Accordingly, an important object of the present invention is to provide a baseball pitching apparatus having a portable frame and fabric drape combination that holds the pitching target area erect and very effectively dissipates the energy of the thrown baseball as it hits the target without a complex mechanism.

A further object of the invention is to provide a portable baseball pitching apparatus having a light weight tubular frame that flexes rearwardly as the baseball moves into a fabric drape having the pitching target thereon to dissipate the energy of the baseball and to redirect the baseball into a front pocket of the draped fabric for holding the expended pitches.

Another object of the invention is to provide a portable baseball pitching apparatus that can be quickly disassembled, reassembled and transported from one location within a short period of time and either no tools or a minimum of tools required for assembly.

In the preferred embodiment of the invention, the invention is comprised of a tubular frame generally configured into a number of interconnected rectangular shapes in different planes, a fabric drape positioned to attach to at least one end of a predetermined number of planar rectangular shapes to suspend the fabric in a generally vertical target area for a pitching target that permits the rectangular tubular shapes to flex in relationship to one another for dissipating the energy of the baseball hitting the target area of the fabric drape.

In one embodiment, the tubular frame of the portable baseball pitching apparatus is comprised of three quarter inch outside diameter 18 gauge steel tubing. The easily assembled frame consists generally often component parts of steel tubing that join together to form the unique portable baseball pitching apparatus. Two component parts are horizontal base members which are parallel and spaced apart from one another in the assembled frame that are generally mirror images of each other. Each tubular base member includes a generally vertical extension of the tubing that is perpendicular to its length and located toward the rear end thereof, and a nearly adjacent extension of tubing that is generally angled away from the vertical extension in an angle greater than 90° toward the front end of the tubular base member when assembled. The front and rear ends of each tubular base member are open. The front ends of each tubular base member slope upwardly at an angle less than 90° from the horizontal plane of each members length. Four component parts of the frame are U-shaped cross bar members of generally the same dimensions having a predetermined length in the middle with generally rounded corners of approximately 90° degrees and each having legs on the U-shape extending upwardly from the middle length to tapered male ends. Next, four component parts of the frame are generally straight upright members of generally the same dimensions that have an open female end and a male tapered end.

The assembly of the ten component pans of the frame requires no tools. First, the front and rear ends of each tubular base member are joined in a predetermined fixed parallel and spaced apart relationship to one another by inserting the tapered male ends of two cross bar members into the front and rear corresponding female ends of the base member, respectively. The four tubular upright members of a predetermined length are then inserted with their male tapered ends into the corresponding female mating ends at the top of the generally vertical and angled extensions on the tubular base members. The four tubular upright members that are mated securely to the vertical and angled extensions on the tubular base lengths are then joined to their opposing upright member on the other tubular base member at their respective top female ends by inserting the male tapered ends of the two remaining U-shaped tubular cross bar members into the top female ends of the upright members in the vertical and angled extensions, respectively.

When the ten tubular components of the frame are assembled in the mated manner as previously described above, there are generally four rectangular planes. Two planes are formed by the base assembly. One plane is horizontally oriented which forms a stable base for the frame and a second rectangular shaped plane slopes upwardly from the base plane at the front of the apparatus toward the pitcher. A third rectangular plane is formed by the two upright members inserted in the vertical extensions on the tubular base members with a cross bar member joined between the top ends of each upright member. A fourth rectangular plane is formed by the two uprights extending up from the angled extensions on the tubular base members that are joined together at their tops by the cross bar member therebetween.

A pitching tarp consisting of a 19 ounce laminated coated vinyl fabric forms the target drape on this apparatus. The generally rectangular shaped tarp includes a sewn front end enclosed space extending laterally across the tarp for the insertion of the front cross bar member therethrough to secure the front end of the tarp to the cross bar member. Next, the tarp drapes across the base member and extends upwardly to a laterally sewn pocket in the tarp that the cross bar member across the upright members in the angled extensions is inserted. The tarp then drapes down behind its connection at the top of the angled uprights cross member and forms a loop before extending upwardly again to the top the vertical cross bar member where another sewn lateral pocket receives the vertical cross bar member therein to secure the rear of the tarp to the frame for providing a pitching target that is securely joined to the frame. This means of affixing the tarp to the frame provides a pitching apparatus that can receive baseballs thrown at any velocity by little league to major league pitchers without adverse effects to the apparatus.

Yet another embodiment includes a heavier frame of 1" O.D. 14 gauge tubular steel that is formed of basically the same dimensioned tubular frame members but further includes semicircular side plates with nuts and bolts that secure the cross bar members to the base members, the vertical and angled extensions and upright members. As a heavier duty construction, it can withstand even more high velocity pitches than the previous embodiment without adverse effects.

Other features and advantages of the invention, which are believed to be novel and nonobvious, will be apparent from the following specification taken in conjunction with the accompanying drawings in which there is shown a preferred embodiment of the invention. Reference is made to the claims for interpreting the full scope of the invention which is not necessarily represented by any one embodiment.

BRIEF DESCRIPTION OF THE DRAWINGS

FIG. 6 is a left side elevation of the apparatus of FIG. 1.

FIG. 7 is a rear elevation of the apparatus of FIG. 1.

FIG. 8 is a cross section of FIG. 7 taken along lines 8—8.

FIG. 9 is an exploded right front perspective view of the frame of the baseball pitching apparatus as shown in FIG. 1.

FIG. 10 is a perspective view of the mating of the tapered ends and openings in the frame tubing as shown in FIG. 9.

DETAILED DESCRIPTION

Although this invention is susceptible to embodiments of many different forms, a preferred embodiment will be described and illustrated in detail herein. The present disclosure exemplifies the principles of the invention and is not to be considered a limit to the broader aspects of the invention to the particular embodiment as described.

Figure 1:
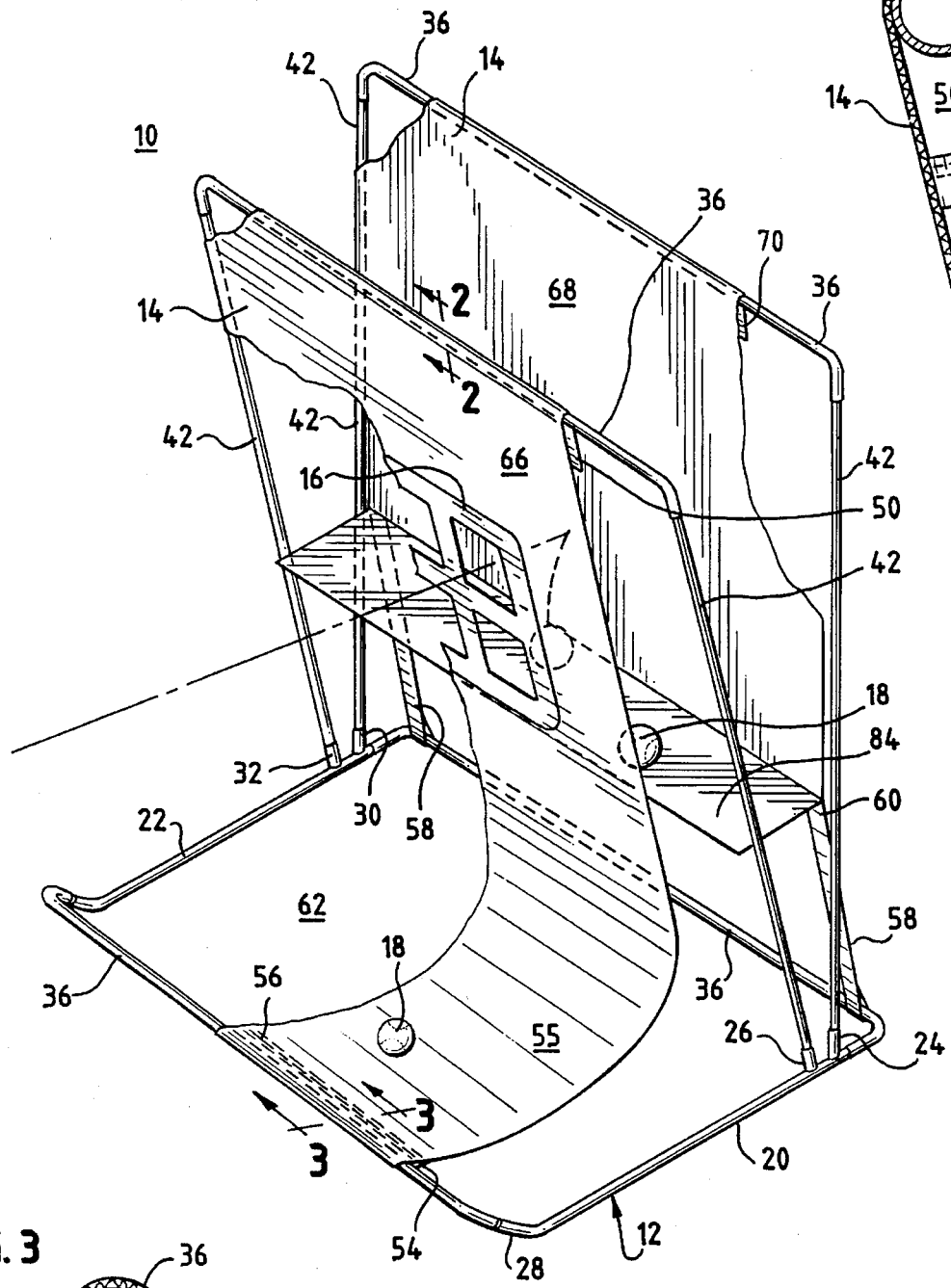
FIG. 1 illustrates the construction of a baseball pitching apparatus according to the present invention.

FIG. 1 shows a baseball pitching apparatus 10 according to the present invention. The apparatus 10 comprises a tubular frame 12 fabricated from various lengths of semi-rigid material such as steel. The frame 12 may also be constructed from aluminum, reinforced fiberglass or polyvinylcholoride or the like so long as the framing material is somewhat flexible. Although the steel frame 12 of the present invention is fabricated from round tubular steel, it may have an angle, square, or rectangular cross section too. The frame 12 is made from a tubular ¾" O.D. 18 gauge steel. A tarp 14 fabricated from 19 ounce laminated coated vinyl is draped over the frame 12 to form a pitching target 16 for a baseball 20 that is thrown by a pitcher or hit by a batter. The frame 12 is comprised of ten component members. The component members are two base members 20 and 22, respectively, which are mirror images of each other. The right base member 20 includes a right vertical extension 24 at approximately a 90° to the length of the base member 20 and an right angled extension 26 that is angled toward a front end 28 and forms an angle of less than 90° with respect to the front end of the base member 20. Both the vertical and angled extensions 24 and 26, respectively, are located near the rear of the base member 20 and have male tapered ends 25. The front end 28 of base member 20 is slightly sloped upwardly at an angle greater than 90° with respect to the base member 20. The base member 22 includes the same left vertical and angled extensions 30 and 32, respectively, with the male tapered ends 31 and a slightly sloped upwardly front end 34 which are mirror images of the shapes and dimensions of base member 20.

As shown in FIGS. 1 and 9, the frame 12 further includes four U-shaped cross bar members 36 of generally similar dimensions having a pair of legs 38 with male tapered ends 40. In addition, the frame 12 includes four straight uprights 42 having female mating openings 44 for receiving the male tapered ends 38 of the cross bar members 36 and the tapered males ends 25 and 31 of the right and left vertical and angled extensions of base members 20 and 22, respectively. The frame 12 is simply assembled without tools by inserting the cross bar members 36 in the openings of the right and left front ends 28 and 34, respectively, and a right and a left rear ends 44 and 46, respectively of base members 20 and 22. The four upright members 42 are inserted over the tapered male ends 25 and 31 on the right and left base members 20 and 22, respectively. Then the two remaining cross bar members 36 have their tapered ends 40 inserted into the openings 44 on the top end of the upright member 42. The tapered male ends and the female openings may include a ball and detent or other means to more securely mate the tubular parts together.

Figure 2:
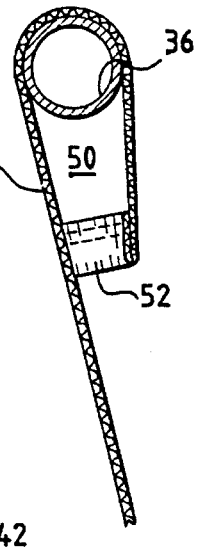
FIG. 2 is a cross section of FIG. 1 taken along lines 2—2.
Figure 3:
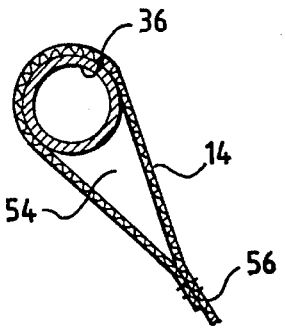
FIG. 3 is a cross section of FIG. 1 taken along lines 3—3.

FIG. 2 is a cross section taken along lines 2—2 of FIG. 1. FIG. 2 shows a cross section of cross bar member 36 in a pocket 50 having a pair of sewn ends 52 so that the pocket 50 is fit over the cross bar member 36 to vertically drape the tarp 14 downwardly to form a front channel 54 out of the tarp 14 as it slopes upwardly to attached to the front cross bar member 36. FIG. 3 is a cross section taken along lines 3—3 and its shows the cross bar member 36 extending through an opening 54 formed by the tarp rapped around the cross bar member 36 and sewn at a lateral stitch 56 back onto itself.

Referring back to FIG. 1 and FIGS. 6, 7 and 8, a pair of nylon straps 58 or the like are sewn at one end 60 spaced apart on either side of the tarp 14 at a predetermined point above the base member 20 and 22 and rear cross bar member 36 forming a generally rectangular plane 62. The straps extended downwardly to the rear cross bar member 36 and wraps around the bar and includes a button snap 64, as shown in FIG. 8, for securing the tarp 14 to the lower base rectangular plane 62. The tarp 14 which is draped over a rectangular plane 66 formed by the angled extensions 26 and 32, uprights 42 and the cross bar member 36 provides the target area for the pitcher while a rectangular plane 68 formed by the vertical extensions 24 and 30, uprights 42 and cross bar member 36 adds stability to the frame and fabric drape of the tarp combination so that the target area 16 is held erect while effectively dissipating the energy of the baseball 18 as shown in FIGS. 1 and 6. The stability is furthered by the tarp 14 having a second pocket 70 that fits over the rear cross bar member 36 as shown in FIGS. 1, 2, 4, 5, 6, and 7 while the straps 58 put tension between the rectangular planes 66 and 68 with the tarp 14 drape over their cross bar members 36.

Figure 4:
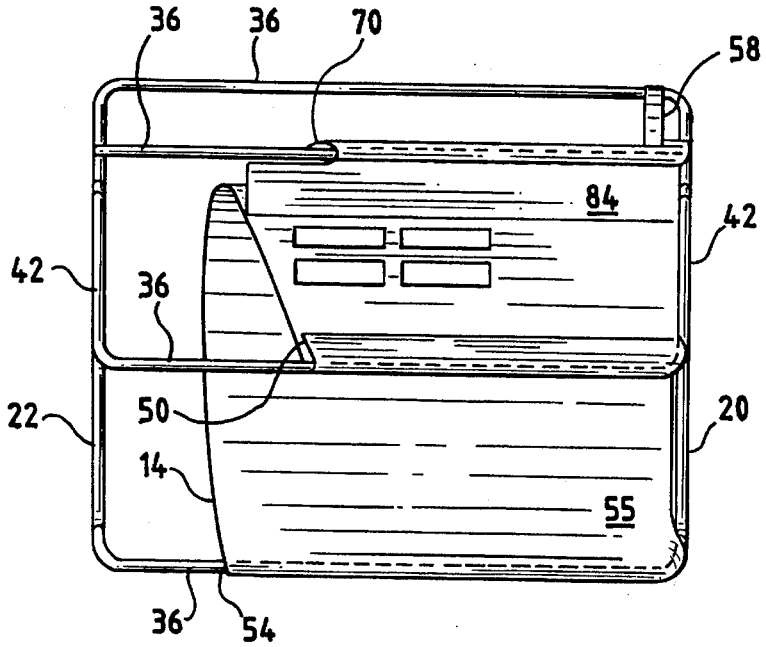
FIG. 4 is a top plan view of the apparatus of FIG. 1.

FIG. 4 show a top view of the baseball pitching apparatus with its tarp 14 cut away for viewing the rear pocket 70, middle pocket 50 and front opening 54 for mounting the cross bar members 36 therein to hold the pitching target 16 and the tarp 14 in a fixed relationship with respect to the assembled frame 12 and to form a retention channel 55 in front of the angled upright rectangular plane 66.

Figure 5:
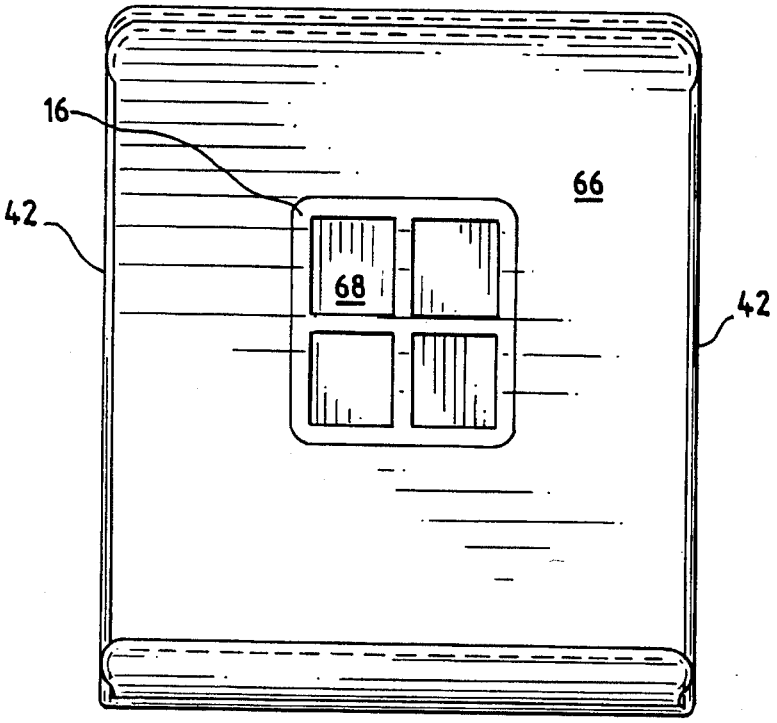
FIG. 5 is a front elevation of the apparatus of FIG. 1.

FIG. 5 shows a front elevation of the baseball pitching apparatus in which the cross bar members 36 are dotted line in their pockets and openings on the frame 12. It gives a good look at what the pitcher sees as he gets ready to throw his practice pitches into the target area 16.

FIG. 7 is rear elevation of the baseball pitching apparatus in which the pair of straps 58 are shown sewn or affixed to the tarp at point 60 at either side of the tarp 14. One of the straps 58 is detached from the rear cross bar member 36 and the other strap 58 is attached around the rear cross member bar 36.

FIG. 8 is a cross section of FIG. 7 taken along lines 8—8, in which the construction of the strap 58 and its button snap 64 are shown in more detail as it wraps around the rear cross bar member 36 to hold the tarp in tension between the plane 66 and 68.

FIG. 9 shows an exploded right front view of the frame 12 for a baseball pitching apparatus 10 made in according with the present invention. The unique light weight steel frame 14 of the invention shows how easily the frame 14 can be transported in ten separate component members erected, used and disassembled by anyone without the need for a single tool for assembly.

FIG. 10 demonstrates the mating of an opening 44 in an upright 42 and a tapered end 25, 31 or 40 on the right and left angled or vertical extensions and cross bar members, respectively. Although one type of construction is shown, other types of fastening means like ball and detent may be used to secure the various tubular members to one another.

Figures 11, 12:
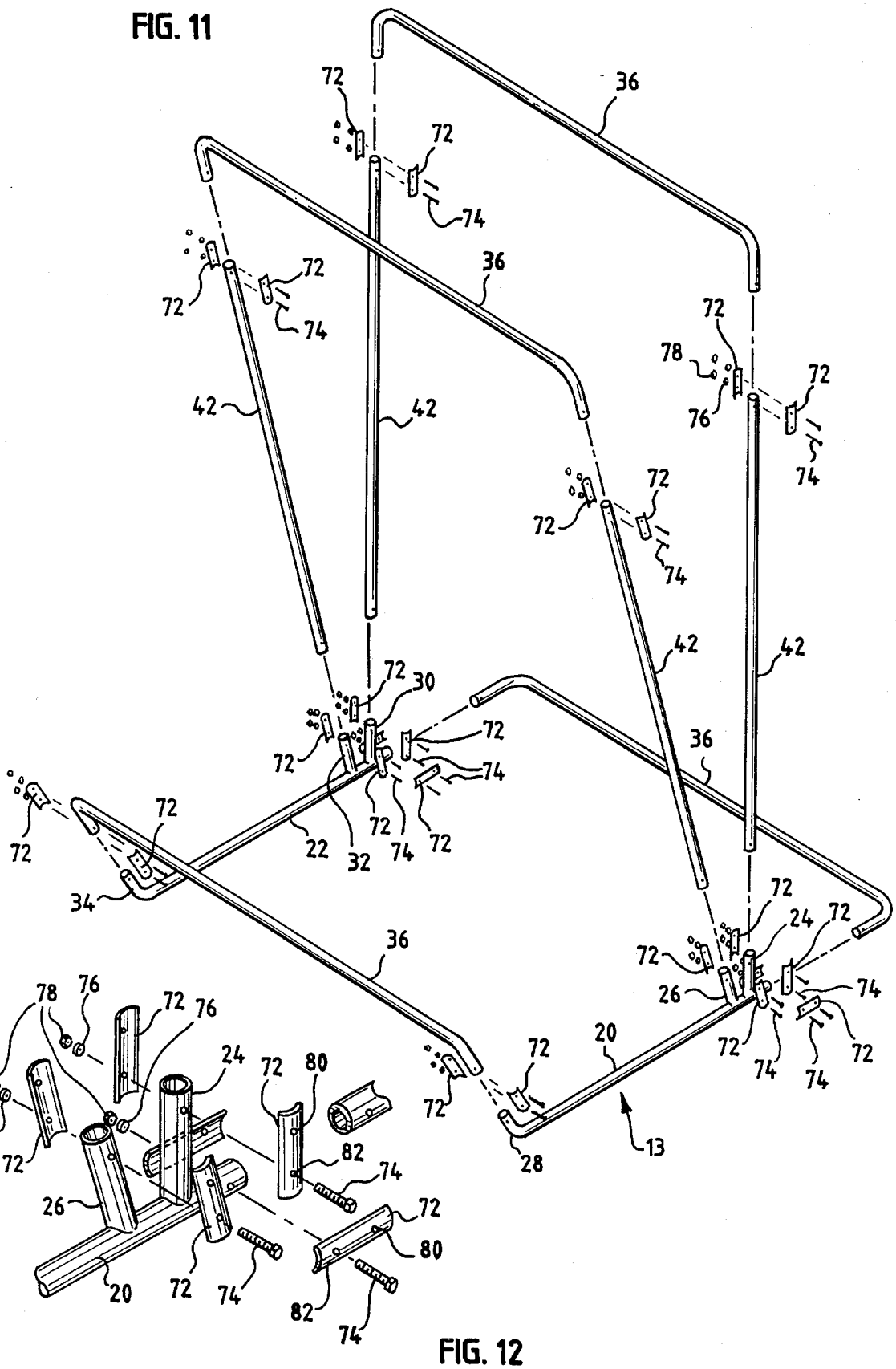
FIG. 11 is a second embodiment of the exploded right front perspective view of the frame of the baseball pitching apparatus as shown in FIG. 1.
FIG. 12 is an exploded view of the couplings and bolts or pins that connected the frame members as shown in FIG. 11.

FIG. 11 shows the construction of a heavier duty frame 14 for the present invention. Instead of the male and female mating arrangement of the earlier embodiment for assembling the Frame component members together, semicircular steel plates 72 with a pair of openings 80 and 82 therethrough and a threaded bolt 74 having a washer 76 and a capture nut 78 to tighten the plates against the tubular members of the frame 14 in a very secure fashion which replaces the mating arrangement or may be used in addition to the mating arrangement to securely fasten the tubular frame members together.

In short, the baseball pitching apparatus according to the present invention provides a portable training device that not only creates a target area for the pitcher to focus on and gauge the accuracy of his pitch in the strike zone, but the front plane 66 defined by the upright members 42 and cross bar member 36 with the tarp thereover flexes slightly backward as a baseball 18 strikes the tarp 14 at a high velocity of speed and the combination of the tarp and flexing tubular members of the frame cleanly dissipates the force of the baseball as shown in FIGS. 1 and 6. The baseball 18 is then directed to the front channel 55.

The front upright members 42 anchored in the angled extensions 26 and 32 is angled forward in a predetermined fashion. The tarp 14 which drapes down from the front cross bar member 36 and its pocket 50 therein hangs unencumbered and moves with the baseball without striking the structural frame or upright members 42. The flexing of the upright members 42 in the rectangular plane 66 further dissipates the energy by flexing as the baseball moves into the drape of the tarp 14.

The front portion of the tarp 14 acts to frame the target area 16 and collect misguided baseballs that miss the strike zone. The rear portion of the tarp 14 draped over the rectangular plane 68 can be marked with the appropriate target to help focus the pitchers on different areas of the strike zone. In this case, the target area 16 frames an opening through the front drape of the tarp 14 on rectangular plane 66, an the baseball goes therethrough when a strike is thrown to hit the rear drape on plane 68. The rear drape of the tarp 14 acts to dissipate the energy of the baseball and redirects it down to a unique baffle 84. A ball bag or container (not shown) can be affixed to one end of the baffle to collect the baseballs.

The unique baseball pitching apparatus according to the present invention allows for the practical and cost effective manufacturing by using tubular components with similar dimensions, wedged ends or split couplings with bolts or quick pull pins that make it easy to assemble or disassemble and to transport to another location with a minimum of tools necessary to do the job.

While the specific embodiments have been illustrated and described, numerous modifications are possible without departing from the scope or spirit of the invention. One such modification is to have the baseball strike the front drape in plane 66 for all throws and eliminate the strike zone 16 that leads the baseball to the rear drape to dissipate the energy. The framing material may be changed to a something different than steel and still give the same flexing ability necessary for the draped tarp 14 and supports members on the frame to dissipate the energy from the baseball.

We claim:

1. A baseball pitching apparatus comprising:

a frame defining at least three, different generally rectangular planes, a first plane formed by a pair of mirror image tubular base members that are parallel, horizontal and spaced a predetermined distance apart from one another and each having a front and rear end, each base member having two upwardly extensions that taper at their ends, one extension is angled approximately 90° from the horizontal length of the base member and the other extension is angled toward the front end of the base at an angle less than a 90° angle, a first pair of U-shaped cross bar members having tapered leg ends inserted into the front and rear ends of the base members, a second plane formed by a first pair of upright member having lower and upper ends, said lower ends inserted over the tapered ends of the angled extension and having a U-shaped cross bar member having tapered leg ends inserted into the upper ends of said pair of upright members, a third plane formed by a second pair of uprights having lower and upper ends, said lower ends inserted over the tapered ends of the vertical extensions and having a U-shaped cross bar member having tapered legs ends inserted into the upper ends of said second pair of upright members; and a tarp of a generally rectangular shape having means for attaching it to the front cross bar member, the angled upright cross bar member and the vertical upright cross bar member so that the tarp drapes between the front and angled cross bar members to form a channel for catching errant pitches and drapes between the angled and vertical cross bar members having means attached to the tarp hanging down from the vertical upright cross bar to form a baffle between the drape over the angled and vertical cross bars, said tarp having a target opening through the drape over the angled upright cross bar so that a baseball maybe thrown through the target opening to be stopped by the rear drape over the vertical cross bar and then drop to the baffle therebetween for later retrieval.

2. The apparatus of claim 1, wherein the tubular members are ¾" O.D. 18 gauge steel tubing.

3. The apparatus of claim 1, wherein the tubular members are 1" O.D. 14 gauge steel tubing.

4. The apparatus of claim 1, wherein the tarp is 19 ounce laminated coated vinyl.

5. The apparatus of claim 1, wherein the second and third planes formed by the tubular framing flex upon the impact from a baseball on either drape of the tarp over the second or third planes formed by the tubular framing to dissipate the energy from the thrown pitch, said tarp consisting of two halves, a first half extending from the front cross bar member to the angled upright cross bar member and a second half attached at one end generally horizontally across the back of the first half of the tarp at a predetermined distance between the base and the angled upright cross bar member and stretched therefrom by a pair of straps attached to the backside of the second half of the tarp at one end and to the base at the other end of each strap to form the baffle before extending upwardly to drape over the vertical upright cross bar member.

6. The apparatus of claim 1, wherein the tubular frame breaks down into ten components that are easily transported, assembled and disassembled into the completed frame without any tools.

* * * * *